US009429285B2

(12) United States Patent
Chung et al.

(10) Patent No.: US 9,429,285 B2
(45) Date of Patent: Aug. 30, 2016

(54) DOWNLIGHT AUXILIARY RING

(71) Applicant: Avago Technologies General IP (Singapore) Pte. Ltd., Singapore (SG)

(72) Inventors: Muh Fong Chung, Penang (MY); Choon Guan Ko, Penang (MY); Sian Tatt Lee, Penang (MY); Fook Chuin Ng, Penang (MY)

(73) Assignee: Avago Technologies General IP (Singapore) Pte. Ltd., Singapore (SG)

( * ) Notice: Subject to any disclaimer, the term of this patent is extended or adjusted under 35 U.S.C. 154(b) by 0 days.

(21) Appl. No.: 13/711,318

(22) Filed: Dec. 11, 2012

(65) Prior Publication Data

US 2014/0160736 A1 Jun. 12, 2014

(51) Int. Cl.

| | |
|---|---|
| ***F21S 8/00*** | (2006.01) |
| ***F21S 8/02*** | (2006.01) |
| ***F21V 7/00*** | (2006.01) |
| *F21Y 103/02* | (2006.01) |
| *F21Y 113/02* | (2006.01) |

(52) U.S. Cl.

CPC ..... *F21S 8/03* (2013.01); *F21S 8/026* (2013.01); *F21V 7/0016* (2013.01); *F21Y 2103/02* (2013.01); *F21Y 2113/02* (2013.01)

(58) Field of Classification Search

CPC ..... F21S 8/024; F21S 8/02; H01H 13/14
USPC ..... 174/66; 323/905; 362/227–253
See application file for complete search history.

(56) References Cited

U.S. PATENT DOCUMENTS

| | | | | |
|---|---|---|---|---|
| 3,058,020 | A * | 10/1962 | Balan | 313/46 |
| 4,211,955 | A * | 7/1980 | Ray | 315/53 |
| 6,005,308 | A * | 12/1999 | Bryde et al. | 307/157 |
| 7,500,766 | B1 * | 3/2009 | Reynolds | 362/364 |
| 8,646,940 | B2 * | 2/2014 | Jang | 362/235 |
| 2005/0073848 | A1 * | 4/2005 | King et al. | 362/296 |
| 2007/0147031 | A1 * | 6/2007 | Barozzini et al. | 362/228 |
| 2007/0274082 | A1 * | 11/2007 | Kay | 362/364 |
| 2007/0285921 | A1 * | 12/2007 | Zulim et al. | 362/240 |
| 2011/0080741 | A1 * | 4/2011 | Noh | 362/294 |
| 2011/0170294 | A1 * | 7/2011 | Mier-Langner et al. | 362/294 |
| 2012/0206926 | A9 * | 8/2012 | Chou | 362/365 |
| 2013/0120997 | A1 * | 5/2013 | Teller | 362/256 |
| 2013/0201697 | A1 * | 8/2013 | Osada et al. | 362/373 |

(Continued)

FOREIGN PATENT DOCUMENTS

| | | | |
|---|---|---|---|
| CN | 201137880 | Y | 10/2008 |
| EP | 2372229 | A1 | 10/2011 |

(Continued)

OTHER PUBLICATIONS

Gotham Architectural Lighting, "6 ALED Drop Luminous . . . ", available at http://www.ledfixturelocator.com/product--2521--6_ALED_Drop_Luminous_Ring_Disk_Decorative_LED_Down--299.html, ledfixturelocator.com, 2 pages.

*Primary Examiner* — Evan Dzierzynski
*Assistant Examiner* — Christopher E Dunay

(57) ABSTRACT

A downlight auxiliary ring device and method of control and use of same is disclosed. Specifically, the downlight auxiliary ring device, comprising light-emitting diodes, allows a dimmable and reduced-glare reflected downlight. It is also an aspect of the present disclosure to provide easy-to-implement and cost-effective methods of control and use of the downlight auxiliary ring device system.

20 Claims, 3 Drawing Sheets

(56) References Cited

U.S. PATENT DOCUMENTS

| | | | | |
|---|---|---|---|---|
| 2013/0229823 | A1* | 9/2013 | Sanford, Jr. | 362/554 |
| 2014/0022808 | A1* | 1/2014 | Chan | 362/516 |
| 2014/0071681 | A1* | 3/2014 | Ghafoori et al. | 362/249.14 |
| 2014/0085883 | A1* | 3/2014 | Douglas et al. | 362/235 |
| 2014/0104839 | A1* | 4/2014 | Chien | 362/253 |
| 2014/0133145 | A1* | 5/2014 | Choi et al. | 362/235 |
| 2014/0139108 | A1* | 5/2014 | Sarmadi et al. | 315/113 |
| 2014/0140096 | A1* | 5/2014 | Van Bommel et al. | 362/609 |
| 2014/0185291 | A1* | 7/2014 | Gotay et al. | 362/249.01 |

FOREIGN PATENT DOCUMENTS

| | | | |
|---|---|---|---|
| JP | 3162973 | A | 7/1991 |
| KR | 20030030805 | A | 4/2003 |

* cited by examiner

DOWNLIGHT AUXILIARY RING

FIELD OF THE DISCLOSURE

The present disclosure is generally directed toward illumination devices and systems.

BACKGROUND

Light-emitting diode (LED) lighting has become widely available to replace compact fluorescent lights (CFL) and incandescent products. LED lighting provides advantages including a reduction in power requirements, longer life and less environmental waste. Further, LED lighting is considered to provide improved aesthetics. Frequently, LED lighting is installed in a downlight configuration, causing unwelcomed glare. Also, traditional downlight LED installations provide only a binary on or off illumination, causing a user to either turn the LED lighting completely off (making a room too dark, for example during a presentation or while viewing a video) or completely on causing the aforementioned unwelcomed glare. No controllable dimming and/or controlled blending with other light sources is provided. Attempts to modify traditional LED installations to improve or mitigate the afore-mentioned problems traditionally do not complement and/or integrate with existing lighting systems.

SUMMARY

It is, therefore, one aspect of the present disclosure to provide a downlight auxiliary ring device comprising one or more light sources which provide a reflected or indirect downlight. It is also an aspect of the present disclosure to provide methods of control and use of the downlight auxiliary ring device.

The downlight auxiliary ring device, in some embodiments, is fitted with one or more light sources positioned on a distal portion of the auxiliary ring. The one or more light sources are arranged to emit light toward a reflective surface such that the reflected light is directed downward. The reflected light is of reduced glare than if emitted directly downward.

In one embodiment, an auxiliary ring is disclosed, the auxiliary ring comprising: a body comprising: a proximal portion configured to engage a perimeter surface of a downlight; and a distal portion configured to receive or support one or more light sources, the one or more light sources being positioned to emit light toward a reflective surface such that the light reflects downward.

In one embodiment, an illumination system is disclosed, the illumination system comprising: a downlight comprising an outer flange, the outer flange positioned proximate to a radial extremity of the downlight; an auxiliary ring comprising: a body, the body comprising a proximal portion configured to engage the outer flange of the downlight, and a distal portion configured to receive one or more light sources, wherein the proximal portion of the body of the auxiliary ring is secured to the outer flange of the downlight, wherein the one or more light sources are positioned to emit light toward a reflective surface.

The present disclosure will be further understood from the drawings and the following detailed description. Although this description sets forth specific details, it is understood that certain embodiments of the invention may be practiced without these specific details.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosures.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

Figure 1A:
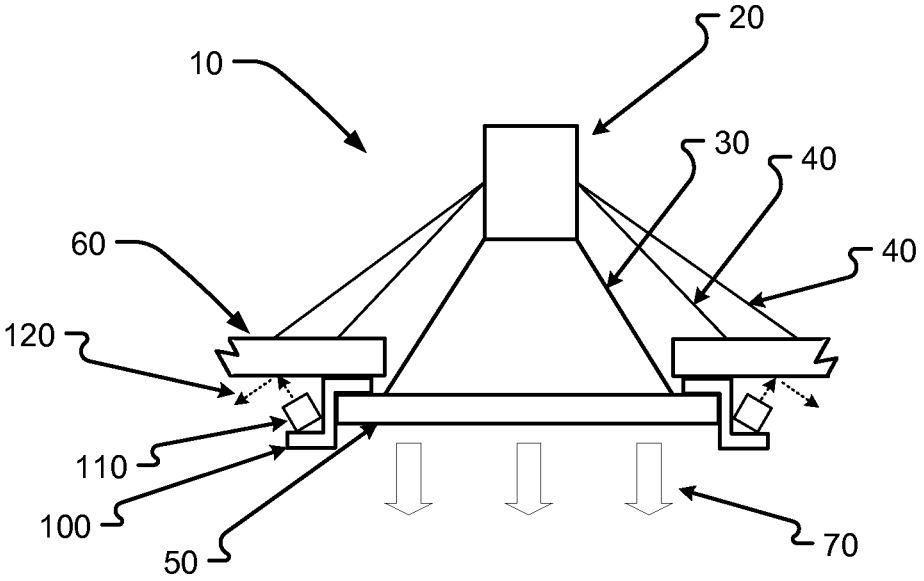
Figure 1B:
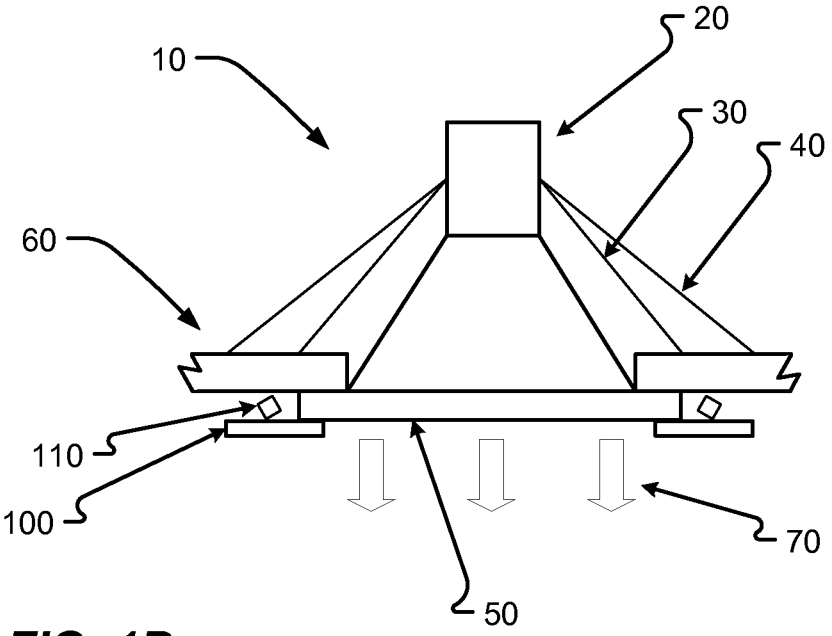
Figure 2A:
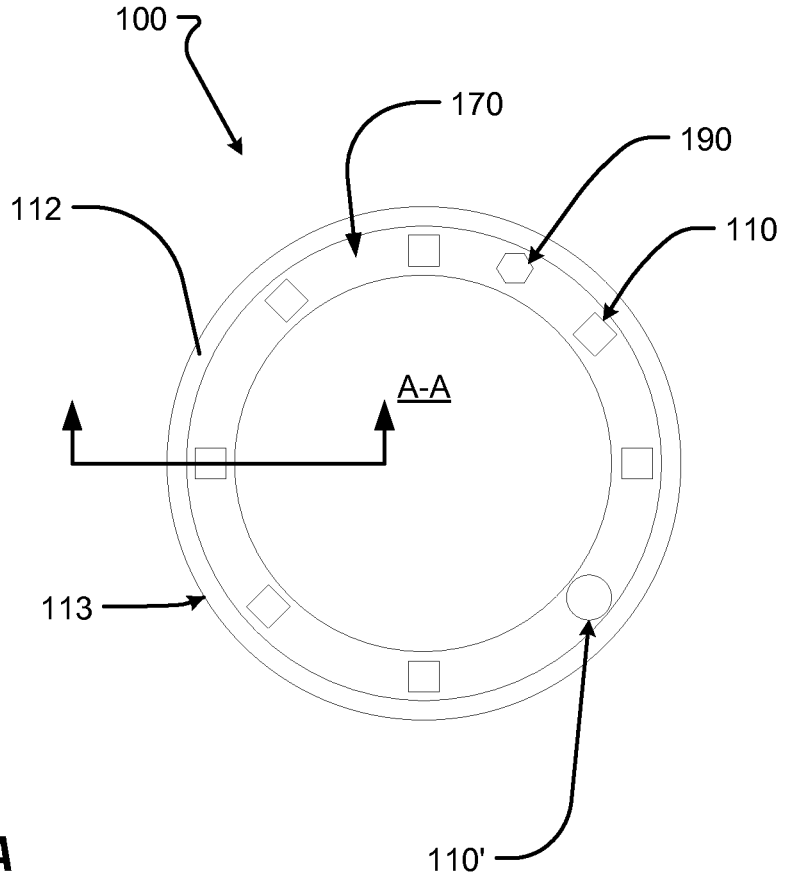
Figure 2B:
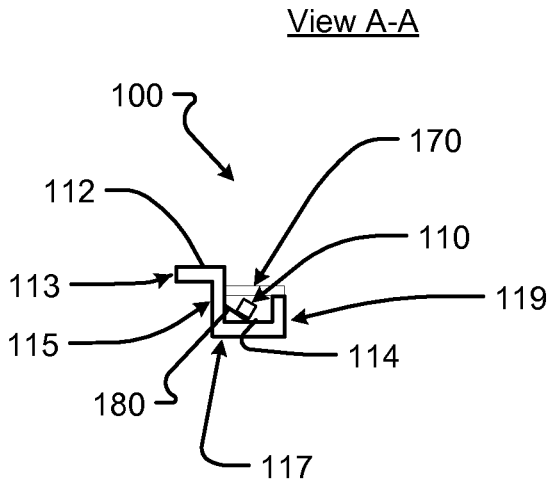
Figure 3:
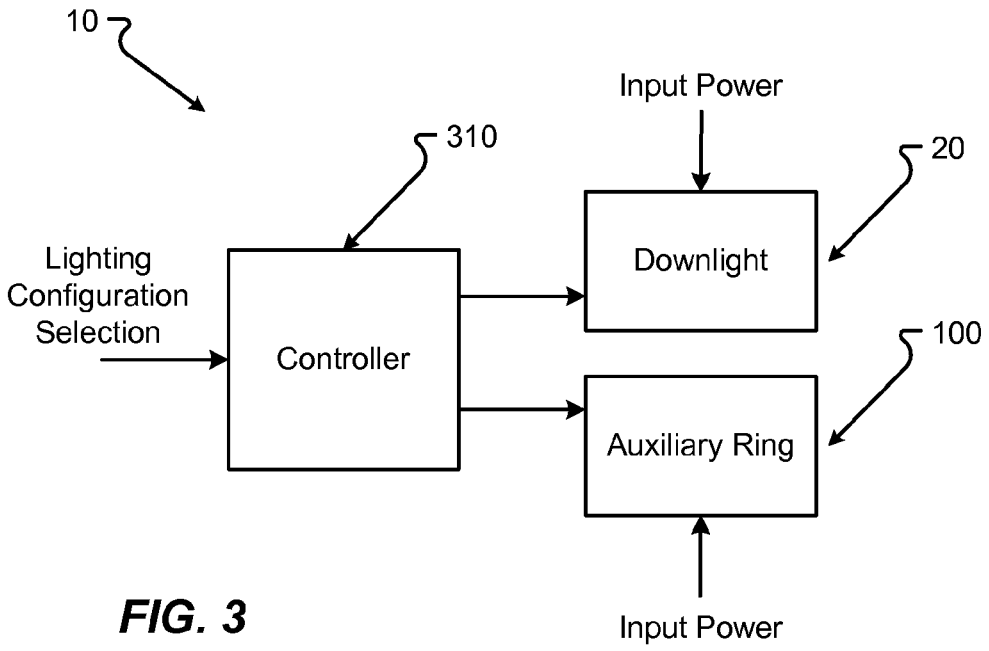

The present disclosure is described in conjunction with the appended figures:

FIG. 1A is a cross-sectional side-view of an illumination system in accordance with at least some embodiments of the present disclosure;

FIG. 1B is a cross-sectional side-view of an illumination system in accordance with at least some embodiments of the present disclosure;

FIG. 2A is a bottom view of a downlight auxiliary ring device in accordance with at least some embodiments of the present disclosure;

FIG. 2B is a cross-sectional side-view along line A-A depicted in FIG. 2A; and FIG. 3 is a schematic-diagram representation of an illumination system in accordance with at least some embodiments of the present disclosure.

DETAILED DESCRIPTION

The ensuing description provides embodiments only, and is not intended to limit the scope, applicability, or configuration of the claims. Rather, the ensuing description will provide those skilled in the art with an enabling description for implementing the described embodiments. Preferred embodiments are described to illustrate the present invention, not to limit its scope, which is defined by the claims. Like elements in various embodiments are commonly referred to with like reference numerals. It being understood that various changes may be made in the function and arrangement of elements without departing from the spirit and scope of the appended claims.

Referring now to FIGS. 1-3, representations and configurations of the device, methods of manufacture of the device, and methods of use of the device are shown.

In regard to FIGS. 1A-B, side-views of two configurations of an illumination system 10 are provided. The system 10 and components thereof will be described in accordance with at least some embodiments of the present disclosure.

FIGS. 1A-B depict a system 10 comprising downlight 20, downlight lower portion 30, downlight attachment springs 40 and downlight flange area 50. Downlight 20 is shown mounted to a mounting surface 60, such as a ceiling, wall, floor, or the like, emitting a downward light directly away from the mounting surface. The directly-emitted light will be referred to herein as downward light 70, but it should be appreciated that embodiments of the present disclosure are not necessarily limited to ceiling installations.

One or more light sources 110 are disposed on an upper surface of auxiliary ring 100. Light source(s) 110 are configured to emit light upwards at an angle which is offset from vertical (e.g., the direction of light emitted by the downlight), wherein the emitted light is reflected against a surface (here, mounting surface 60) such that the light is reflected downward (as indicated by light arrows 120).

Auxiliary ring 100 is shown in FIG. 1A with flange engaging downlight flange area 50, while in FIG. 1B, auxiliary ring 100 does not include flange area. In the embodiment of FIG. 1A, the auxiliary ring 100 engages, via flange, between mounting surface 60 and downlight flange area 50. In the embodiment of FIG. 1B, the auxiliary ring 100 engages, via flange, solely the downlight flange area 50 at the bottom surface of the downlight flange area 50. Attachment of the auxiliary ring 100 to the downlight 20 in the embodiment of FIG. 1A may be of several means, to include gravity mount, friction mount, snap fit, adhesive, bolt and nut, and loop and eye. Attachment of the auxiliary ring 100 to the downlight 20 in the embodiment of FIG. 1B may be of several means, to include adhesive, snap fit, bolt and nut, and loop and eye.

The light sources 110 of the auxiliary ring 10 may be powered by a stand-alone power source or by a common power source with the downlight 20. The power sources for one or both of the auxiliary ring 10 and the downlight 20 may be direct current (DC) or alternating current (AC). In one embodiment, the auxiliary ring is powered by a 12 volt AC power source.

The one or more light sources 110 may, in some embodiments, correspond to a Light Emitting Diode (LED), an array of LEDs, an Organic LED (OLED). In some embodiments, where the light sources 110 correspond to one or more LEDs, the LEDs may be in the form of surface mount LEDs or thru-hole mount LEDs. As can be appreciated, any other type of light source may be used without departing from the scope of the present disclosure.

FIG. 2A depicts a bottom view of the downlight auxiliary ring device 100 in the embodiment of FIG. 1A. The circular geometry of the auxiliary ring is apparent from FIG. 2A. It should be appreciated, however, that the auxiliary ring device 100 may have a non-circular geometry without departing from the scope of the present disclosure. A plurality of light sources 110 are shown, disposed at substantially equal radii from the center (e.g., from where a downlight device would be positioned at center). The light sources 110 may be of identical or different types. For instance, one different light source 110' is shown in addition to a plurality of light sources 110. The different light source 110' may be different from one of the other light sources 110 in any number of ways. For example, the different light source 110' may produce light of a different color (e.g., wavelength) than that produces by light sources 110. Alternatively or additionally, different light source 110' may be configured to emit light of a different brightness than light sources 110. As still another example, different light source 110' may be configured with a lens or encapsulant that conditions or shapes light differently from the other light sources 110. In short, it should be appreciated that the downlight auxiliary ring device 100 may be configured to support light sources of the same or different types.

A power source 190 for the auxiliary ring 100 is also depicted. The power source 190 may correspond to a DC power source (e.g., battery) that provides DC current to the light sources 110, 110'. In other embodiments, the power source 190 may correspond to a power conditioner that receives AC power from a grid-based power source (e.g., conventional 120V 60 hz AC power) and converts that AC power such that it can be used to drive the light sources 110, 110'.

FIG. 2B depicts a cross-sectional side-view of the downlight auxiliary ring device 100 as shown in FIG. 2A as taken at section line A-A. Auxiliary ring 100 comprises flange 113 with flange upper surface 112, first sidewall 115, second sidewall 119 and channel 117 with channel light source mounting surface 114. Channel 117 connects first sidewall 115 with second sidewall 119. An adjustable shelf 180 is disposed on the channel light source mounting surface 114. A light source 110 is disposed on the channel light source mounting surface 114. The adjustable shelf 180 enables selectable adjustment of the orientation of light source 110 such that the light emitted from the light source may be at a selectable angle. Adjustable shelf 180 may be manually adjusted or adjusted remotely by, for example, a controller. A light diffuser 170 is attached to first sidewall 115 and second sidewall 119. Light emitted from light source 110 passes at least partially through light diffuser 170, therein reflecting off mounting surface 60 and or reflecting within light diffuser 170, then continuing away from the mounting surface 60. The light diffuser 170 diffuses, spreads out and/or scatters the light from the light source 110, thereby providing a softer light of reduced glare. The flange 113 is at a proximal location of the auxiliary ring 100, and the light source mounting surface 114 is at a distal location of the auxiliary ring 100. FIG. 2B depicts one geometry of the downlight auxiliary ring device 100 in which light diffuser 170 is attached to first sidewall 115 and second sidewall 119, thereby forming, with channel 117, a circularly-enclosed chamber. This configuration protects light source 110 from unwelcomed foreign debris, such as dust, from contacting and/or degrading light source 110 quality. It should be appreciated, however, that the auxiliary ring device 100 may have other geometries without departing from the scope of the present disclosure. For example, the second sidewall 119 may be extended upwards such that the light diffuser 170 attaches to flange 113 and flange upper surface 112 forms a substantially planar surface with an upper surface of light diffuser 170. In other embodiments, the geometry of the downlight auxiliary ring device 100 is as described above, except the light diffuser 170 is absent.

In one embodiment, the auxiliary ring 100 may be configured to attach to an existing downlight 20. For example, in the embodiment of auxiliary ring 100 shown in FIGS. 2A-B, the auxiliary ring 100 could be glued onto the bottom surface of an existing downlight 20 such that the light sources 110 reflect from the attachment surface of the existing downlight 20 and thereby provide a reflected downlight.

FIG. 3 depicts a schematic-diagram representation of a controller 310 used to selectively control illumination states of the downlight 10 and auxiliary ring 100. The auxiliary ring 100 may be configured to operate in one or more of an on state, an off state and a scalable dimmer state. Similarly, the downlight 20 may be configured to operate in one or more of an on state, an off state, and a scalable dimmer state. Controller 310 is configured to control the states of each of the auxiliary ring 100 and the downlight 20 either independently or collectively. For example, the controller 310 may provide an illumination system 10 with both auxiliary ring 100 and downlight 20 on, with only auxiliary ring 100 on, with only downlight 20 on, or with both auxiliary ring 100 and downlight 20 off. The control of downlight 20 and auxiliary ring 100 may be achieved by the controller 310 providing one or more control signals to drivers of the downlight 20 and auxiliary ring 100, respectively. In other embodiments, the controller 310 may directly control the amount of current provided from the input power. It should also be appreciated that a common input power may be provided to both the downlight 20 and auxiliary ring 100 while in other embodiments different input powers may be provided to the illumination components.

Although the controller 310 is represented in FIG. 3 as a single element, in some embodiments the controller 310 is a plurality of controllers or sub-controllers, each controlling one or more aspects, processes or elements of the system 10. For example, a sub-controller may control the downlight 20 while another controls auxiliary ring 100.

While the pictorial representations and flowcharts have been discussed and illustrated in relation to a particular sequence of events, it should be appreciated that changes, additions, and omissions to this sequence can occur without materially affecting the operation of the disclosed embodiments, configuration, and aspects.

The present disclosure, in various aspects, embodiments, and/or configurations, includes components, methods, processes, systems and/or apparatus substantially as depicted and described herein, including various aspects, embodiments, configurations embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and\or reducing cost of implementation.

The foregoing discussion has been presented for purposes of illustration and description. The foregoing is not intended to limit the disclosure to the form or forms disclosed herein. In the foregoing Detailed Description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this Detailed Description, with each claim standing on its own as a separate preferred embodiment of the disclosure.

Moreover, though the description has included description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. An auxiliary ring comprising:

a body forming a ring having a central axis, the body comprising:

a proximal planar portion configured to attach to a perimeter surface of a downlight having a downlight emission direction, the perimeter surface of the downlight terminating at a first radial with respect to the central axis, the proximal planar portion extending beyond the first radial away from the central axis: and a distal planar portion configured to receive one or more light sources, the distal planar portion disposed at a second radial with respect to the central axis, wherein the second radial extends farther from the central axis than the first radial wherein the one or more light sources are disposed on the distal planar portion;

wherein the proximal planar portion and the distal planar portion are parallel, and wherein the one or more light sources have an emission direction different than the downlight emission direction.

2. The auxiliary ring of claim 1, further comprising a first power source configured to provide power to the one or more light sources.

3. The auxiliary ring of claim 2, wherein the first power source is a DC power source.

4. The auxiliary ring of claim 1, wherein the light emitted by the one or more light sources is diffused by at least one of a diffuser and air.

5. The auxiliary ring of claim 1, wherein the perimeter surface is parallel to each of the proximal plane portion and the distal plane portion, wherein the perimeter surface comprises an edge which defines a downlight plane, wherein the downlight is configured to emit light adjacent a distal-most point of the perimeter surface that does not extend beyond the downlight plane, wherein the one or more light sources are configured to emit light external to the perimeter surface.

6. The auxiliary ring of claim 1, wherein the one or more light sources are configured to operate at least two of an on state, an off state and a scalable dimmer state, and the downlight is configured to operate in at least two of an on state, an off state, and a scalable dimmer state.

7. The auxiliary ring of claim 6, further comprising a controller, the controller configured to control operational states of each of the one or more light sources of the auxiliary ring and the downlight.

8. The auxiliary ring of claim 1, wherein the one or more light sources emit light in a direction opposite to light emitted by the downlight.

9. The auxiliary ring of claim 1, wherein the one or more light sources comprise at least one of a light-emitting diode (LED) and an organic light-emitting diode (OLED).

10. The auxiliary ring of claim 1, wherein the one or more light sources are positioned on the distal portion at substantially equal radii from a center of the downlight.

11. The auxiliary ring of claim 1, wherein the proximal portion is configured to engage a top surface of the downlight and a mounting surface.

12. The auxiliary ring of claim 1, wherein the proximal portion is configured to engage a bottom surface of the downlight.

13. An illumination system comprising:

a downlight configured to emit a first light, the downlight having a central axis and comprising an outer flange surface positioned at a distal location of the downlight, the outer flange surface circumscribing and defining an outer boundary of a downlight exit area, the outer boundary terminating at a first radial with respect to the central axis;

an auxiliary ring comprising:

a body forming a ring about the central axis, the body comprising a proximal portion with a proximal portion surface, the proximal portion extending beyond the first radial away from the central axis, and a distal portion comprising a distal portion surface, the distal portion at a second radial with respect to the central axis, wherein the second radial extends farther from the central axis than the first radial, wherein one or more light sources are disposed on the distal portion surface, wherein the proximal portion surface is in contact with the outer flange surface, and wherein the one or more light sources are positioned to emit a second light outside and in a direction opposite to light emitted from the downlight exit area.

14. The illumination system of claim 13, further comprising a diffuser, the diffuser positioned external to the downlight and configured to receive light emitted by the one or more light sources.

15. The illumination system of claim 14, wherein the one or more light sources are configured to emit light independent of the downlight.

16. The illumination system of claim 14, wherein both the downlight and the one or more light sources are dimmable.

17. The illumination system of claim 13, further comprising a controller, the controller configured to control operational states of each of the one or more light sources and the downlight.

18. The illumination system of claim 14, wherein the one or more light sources comprise at least one of a light-emitting diode (LED) and an organic light-emitting diode (OLED).

19. An auxiliary ring comprising:

a body forming a ring having a central axis, the body comprising a planar proximal portion configured to attach to an outer perimeter surface of a substantially circular downlight having a downlight an emission direction, and a distal portion comprising a distal planar surface configured to receive one or more light sources, the body radially extending from the central axis beyond the outer perimeter surface, the distal portion radially extending farther from the central axis than the planar proximal portion:

one or more light sources disposed on the distal planar surface, wherein the planar proximal portion and the distal planar surface are parallel, and wherein the one or more light sources have an emission direction different than the downlight emission direction of the downlight.

20. The auxiliary ring of claim 19, wherein the outer perimeter surface is parallel to each of the planar proximal portion and the distal planar portion, wherein the perimeter surface comprises an edge which defines a downlight plane, wherein the downlight is configured to emit light adjacent a distal-most point of the perimeter surface that does not extend beyond the downlight plane.

* * * * *